United States Patent [19]

Nakagawa et al.

[11] Patent Number: 5,045,257

[45] Date of Patent: Sep. 3, 1991

[54] PROCESS FOR PRODUCING AROMATIC POLYESTER FIBER

[75] Inventors: Junyou Nakagawa, Kurashiki; Yoshio Kishino, Okayama; Youichi Yamamoto, Kurashiki, all of Japan

[73] Assignee: Kuraray Co., Ltd., Kurashiki, Japan

[21] Appl. No.: 331,879

[22] Filed: Apr. 3, 1989

[51] Int. Cl.[5] ..... D01D 10/02; D01F 6/62

[52] U.S. Cl. ..... 264/83; 264/85; 264/211.15; 264/211.17; 264/234; 264/345

[58] Field of Search ..... 264/176.1, 205, 83, 264/85, 210.8, 211.15, 234, 235, 345, 346, 211.17

[56] References Cited

U.S. PATENT DOCUMENTS 4,332,759 6/1982 Ide ..... 264/205

*Primary Examiner*—Hubert C. Lorin

*Attorney, Agent, or Firm*—Oblon, Spivak, McClelland, Maier & Neustadt

[57] ABSTRACT

A process for producing aromatic polyester fibers having a high strength and resistances to fibrillation, buckling, abrasion and fatigue. The process comprises spinning aromatic polyesters capable of forming anisotropic melts and heat treating the as-spun fibers, the heat treatment being characterized by a combination of a first heat treatment in an inert atmosphere and a successive heat treatment in an active atmosphere.

7 Claims, 3 Drawing Sheets

*FIG. 2*

PROCESS FOR PRODUCING AROMATIC POLYESTER FIBER

BACKGROUND OF THE INVENTION

1. Field of the Invention

The present invention relates to a process for producing aromatic polyester fibers having high strength and high modulus from aromatic polyesters which are liquid crystals in the melt and the fibers produced by such a process.

2. Discussion of the Background

Aromatic polyester fibers obtained from polymers which form anisotropic melts have a high strength and high modulus and also excellent resistance to heat, chemicals, and the like, and, hence, have attracted much attention. As processes for obtaining such high strength aromatic polyester fibers, Japanese Patent Publication No. 24407/1982 describes a process which comprises heating and stretching an oxybenzoyl copolyester fiber to improve its strength and modulus, and Japanese Patent Publication No. 20008/1980 discloses that heat treatment of an anisotropic melt in an inert atmosphere can increase the strength by 50%.

However, the fibers obtained by the above processes suffer from the drawbacks of readily forming fibrils and being buckled, thereby being inferior in abrasion resistance and resistance to fatigue, since the rigid molecules constituting the fibers are highly oriented. Further, heat treatment for a long-time in an inert atmosphere is required to achieve high strength, which increases the amount of the inert gas used and results in a greater cost.

Thus, there remains a need for a process for producing aromatic polyester fibers which, while maintaining a high strength, are not readily buckled and possess high fatigue resistance and abrasion resistance and the fibers produced by such a process.

SUMMARY OF THE INVENTION

Accordingly, it is one object of the present invention to provide a process for producing aromatic polyester fibers which possess a high strength and a high modulus.

It is another object of the present invention to provide a process for producing aromatic polyester fibers which are not readily buckled and possess a high fatigue resistance and a high abrasion resistance.

It is another object of the present invention to provide aromatic polyester fibers which have a high strength and a high modulus, are not readily buckled, and possess a high fatigue resistance and a high abrasion resistance.

These and other objects of the present invention which will become apparent during the course of the following detailed description have been achieved by a process for producing aromatic polyester fibers which comprises heat treating the fibers at a temperature below their flow temperature in an inert atmosphere for a period of time that does not allow their strength to increase by more than 50%, and thereafter heat treating the fibers in an active atmosphere for a period of time that will increase the strength by at least 50%.

The aromatic polyester fibers of the present invention are formed by extruding aromatic polyesters capable of forming anisotropic melts through a spinneret at a temperature at least 10° C. higher than the flow temperatures of the polymers and at a shear rate of at least 103sec−1. Then the fiber as-spun is heat treated. If the fiber is heat treated in an inert atmosphere to increase the strength by at least 50%, the improvement effect of the present invention on resistances to fatigue and abrasion will not be achieved. The atmosphere in which the heat treatment is performed must be dry, since the presence of moisture causes hydrolysis of the polymer.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein.

O:Heat treated in $N_2$ (A), $\boxed{O}$:Heat treated in dry air (B)

Figure 2:
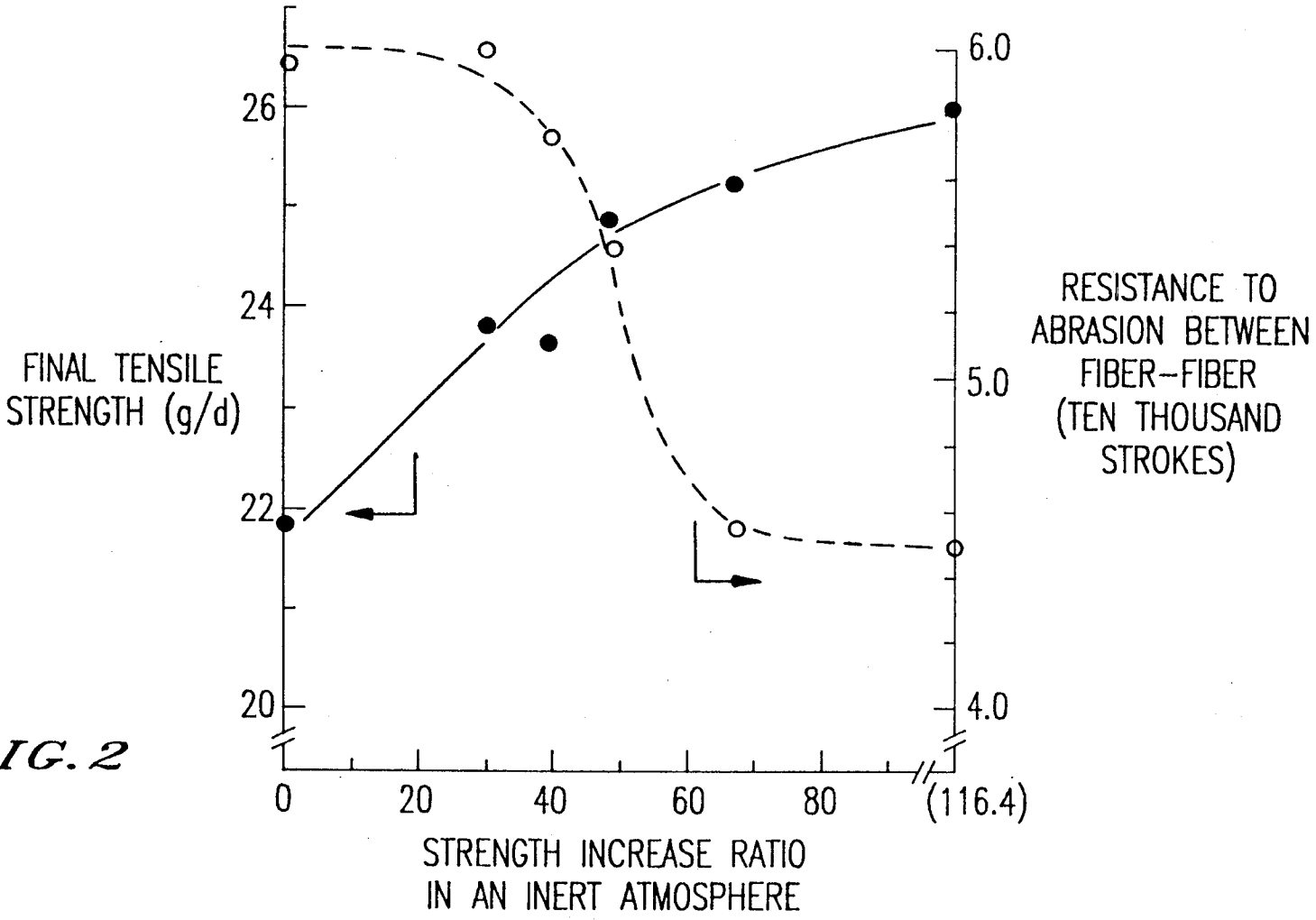
Figure 3:
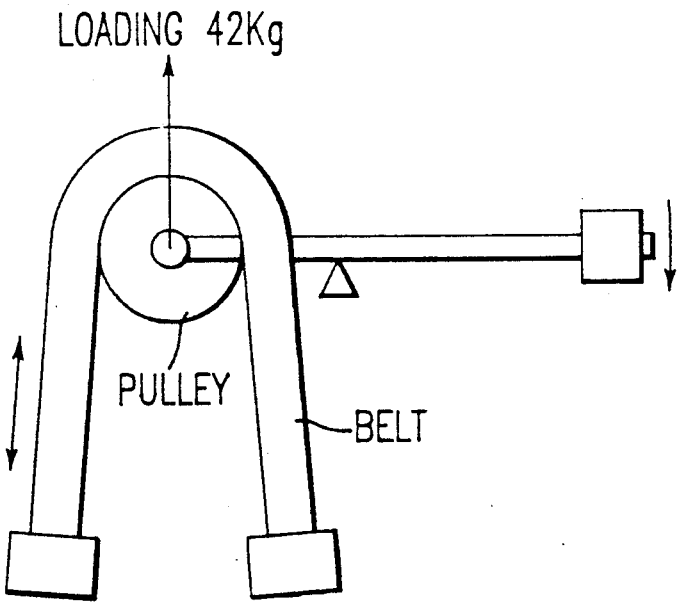

$\boxed{O}$:Heat treated first in $N_2$ for 4 hours and then in dry air (C);

FIG. 2 is a graph showing the relationship between fiber-fiber abrasion resistance and the final strength of the treated fiber, and strength increase ratios achieved by heat treatment, when the treating time in an inert atmosphere is changed; and FIG. 3 is a schematic drawing of an apparatus used for belt flex test.

The details will be explained in Example described later herein.

DESCRIPTION OF THE PREFERRED EMBODIMENTS

The fibers of the present invention are first spun from aromatic polyesters which can form anisotropic melts. The anisotropic-melt-forming aromatic polyesters are polymers derived essentially from the group comprising an aromatic diol, an aromatic dicarboxylic acid, aromatic hydroxycarboxylic acid, and the like, which show an optical anisotropy in the melt phase. The optical anisotropy can readily be determined by observing the light transmitted through a sample of the polymer placed on a heating stage of a polarizing microscope and heated in a nitrogen atmosphere.

Preferred examples of the anisotropic melts used in the present invention are those comprising one of the below-mentioned 8 groups which are separated by semicolons and which consist of 2 to 4 members of the recurring units:

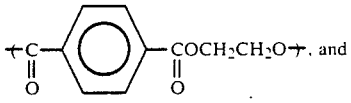

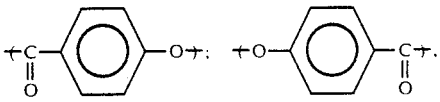

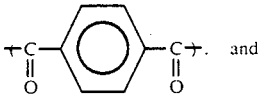

-continued

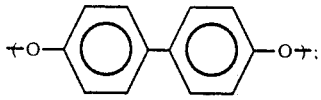

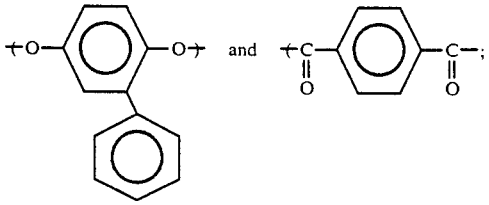

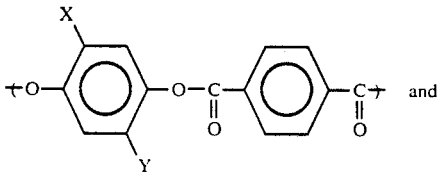

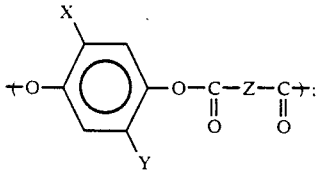

wherein X and Y each represents hydrogen, chloro, bromo or methyl, and Z represents

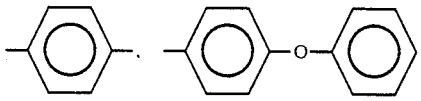

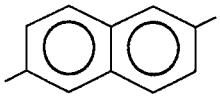

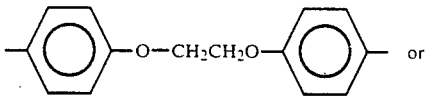

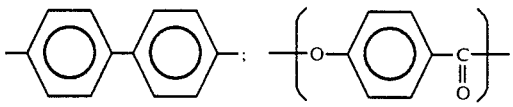

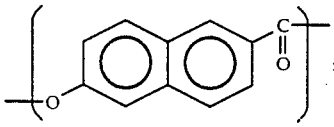

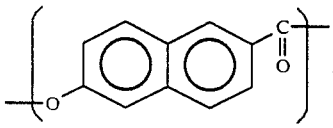

-continued

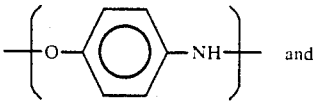

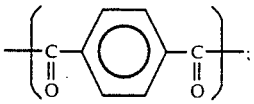

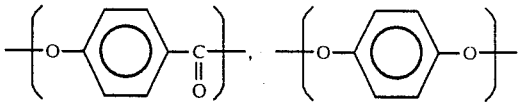

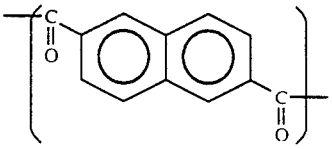

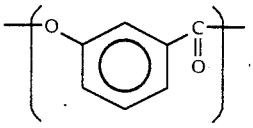

Among the above species, the effect of the present invention is most markedly exhibited with aromatic polymers comprising the combination of

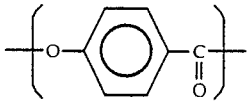

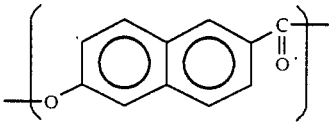

containing in particular, the naphthoyl moiety in an amount of 5 to 50 mol %. Aromatic polyesters which contain at least 90% by weight of this polyester are particularly preferred.

Fibers can be formed from such anisotropic-melt-forming polymers by any known melt spinning technique, such as, for example, those described in Japanese Patent Application Laid-Open Nos. 43223/1975, 157619/1975, 158695/1975, 77691/1979, etc. However, according to a study made by the present inventors, it is necessary to extrude the polymer through a spinneret at a temperature at least 10° C. higher than the flow temperature of the polymer and within the range in which the polymer forms a melt liquid crystal, and at a shear rate of at least $10^3$ sec$-1$. Outside this condition, the orientation of molecules is insufficient, and hence the fibers obtained will not produce the desired high strength by the heat treatmenyt according to the present invention.

The shear rate, Y, as referred to in this invention is calculated from $$\gamma = \frac{4Q}{\pi r^3} \ (\sec^{-1})$$

wherein r is the radius in cm of one hole and Q is the rate of extrusion of the polymer per hole in $cm^3$/sec.

The as-spun fibers used in the present invention preferably have a single filament fineness of from 1 to 10,000 deniers and a tensile strength of from 1 to 20 g/d.

The flow temperature is defined herein as the temperature at which a polymer starts flowing and is readily determined by one skilled in the art by differential scanning calorimetry (DSC). The determination method employed in this invention is as follows.

A sample weighing 10 to 20 mg is sealed in the aluminum pan of a DSC apparatus (e.g., TA 3000 made by Mettler), and measured at a temperature elevating rate of 20° C./min while nitrogen gas is streamed as a carrier gas at a rate of 100 cc/min. The flow temperature is indicated by the temperature at which the endotherm is observed. Sometimes there may not be observed a clear endotherm in the first run of the test depending of the type of polymer tested. In this case, the temperature is first raised at a rate of 50° C./min and the sample is completely melted by heating at a temperature about 50° C. higher than the anticipated melting point for about 3 minutes. Then the molten sample is cooled to 50° C. at a temperature lowering rate of 80° C./min and tested at the temperature elevating rate of 20° C./min.

The heat treatment according to the present invention is characterized in that it is first conducted at a temperature below the flow temperature of the fiber to be treated in an inert atmosphere for such a time period so as to not increase the fiber strength by 50% or more, and then conducted in an active atmosphere to increase the strength by at least 50% based on the strength of the fiber, as spun.

Since the flow temperature of a fiber gradually increases by heat treatment, the above treating temperature may be set higher than the flow temperature of the fiber in the initial stage of the treatment.

The fiber may be heat treated, depending on the purpose, under tension or in a relaxed state, e.g., in a skein, as a cheese, or tow (placed relaxed on a conveyer net), or continuously while running through a pair of rotating rolls. The fiber may be single or multifilament yarn, spun yarn or short cut staple.

By "in an inert atmosphere" is meant in an atmosphere of an inert gas, such as nitrogen or argon, or a reduced pressure, where active gases such as oxygen are present in an amount of not more than 0.1% by volume. A gas containing at least 99.9% nitrogen by volume is preferred for the inert gas.

The fiber, as spun, is treated in such an inert atmosphere at a temperature below the flow temperature, preferably below the flow temperature and above a temperature that is not more than 20° C. below the flow temperature (the flow temperature −20° C.) for such a time period that will not increase the strength of the fiber by 50% or more. In an inert atmosphere, the strength increase up to 50% is achieved in a relatively short period, and hence the consumption of the inert gas is small. If the strength increase exceeds 50%, the prevention of fibrillation and the improvement of resistance to fatigue and abrasion, which are objects of the present invention, will not be achieved perhaps because oxidation and/or crosslinking do not thereby proceed sufficiently. Thus, the fiber is treated first for a period that causes the strength to increase by preferably 30 to 40%, and immediately thereafter (without lowering the treating temperature so much) treated in an active atmosphere.

The active atmosphere is herein defined as an atmosphere containing at least 1% of an active gas such as oxygen, and, commercially, it is most preferrable to use air in terms of cost If the air contains moisture, hydrolysis will occur at the same time. Employment of air having a dew point of −40° C. or below gives a fiber having a high strength as well as the desired fatigue resistance and abrasion resistance. Such low-dew-point dry air is readily obtained by, for example, filtration through molecular sieves.

A great industrial advantage of the present invention is a small consumption of an expensive inert gas, so that its re-use might not be required Where such re-use is not conducted, there is no need for complex recovery equipment or an operation for removing by-products.

The fiber obtained according to the process of the present invention is slightly reddish colored, due to oxidation. The color is more marked as the oxygen concentration in the active gas increases or the treating time increases. The treating temperature is preferably increased gradually to an eventual temperature of not higher than 10° C. below the flow temperature of the as-spun fiber (the flow temperature of as-spun fiber −10° C.), in terms of production cost and the characteristics of the fiber obtained.

Examples of the industrial applications of the fibers obtained by the process of the present invention, similar to the applications of aromatic polyester fibers in general, are as follows.

1. Used in pulp form:
   (1) Anti-friction materials (mixed with other fibers, for reinforcing resins).
   Brake lining, clutch facing, bearings, etc.
   (2) Others
   Packings, gaskets, filters, polishers, etc.
2. Used in the forms of cut fiber and chopped strands:
   Paper (insulating paper, heat-resistant paper), diaphragm of speaker, reinforcing material for cement, reinforcing material for resins, etc.,
3. Used in the forms of monofilament, spun yarn and multifilament yarn:
   Tension members (for optical fiber, and the like), ropes, cords, lifeline, sewing thread, fishing-line, tuna twine, etc.
4. Used in the form of woven or knitted fabrics:
   Inner linings for cars, trains, ships and airplanes; protectives such as armor vests and safety gloves; safety net; plaster casts; fishing nets; fireman's clothing such as uniform, muffler and apron; artificial tendons; and the like
5. Used for reinforcing rubber and resins:
   (1) For rubber
   For reinforcing rubber of tires, belts, various timing belts, hoses, and the like.
   (2) For resins (as hybrids with carbon fiber or glass fiber)
   Linear or two-dimensional structures such as skis; head and shaft of golf clubs or gate ball clubs; helmets; baseball bats; racket frames for tennis, badminton or the like; spectacle frames; print substrate; slot of motor rotor; insulating materials; pipes; high-pressure containers; walls of cars, trains, airplanes, etc.; and the like.

Other features of the present invention will become apparent in the course of the following descriptions of exemplary embodiments which are given for illustration of the invention and are not intended to be limiting thereof.

EXAMPLES

The characteristics referred to in the present invention were evaluated according to methods described below.

Fibrillation

A specimen yarn is run through a 3-bar titanium guide under a tension of 100 g at 100 m/min for one hour, after which the amount of fibrils (microfibers) deposited on the guide is checked and evaluated by the rating:

X:much deposit
Δ:medium deposit
O:no deposit at all

Buckling (compressive distortion)

A specimen is twisted 300 turns/m using a ring twister, and then untwisted. The specimen is observed with a microscope and ranked as:

X:many buckled portions
Δ:a few buckled portions
O:almost no buckled portions

Abrasion resistance

The abrasion resistance is evaluated by the following two methods.

i) The testing apparatus comprises a reciprocally rotating wheel having a diameter of 5 cm and a pulley having a diameter of 5 cm, their rotating axes being horizontal and parallel with each other, and the distance between their centers being 50 cm. 10 pieces of specimen yarns (each 1500 deniers) are bundled, and the bundle is made into a loop The loop is then set, forming an 8-shape, crossing with 1.5 S-turns at the center, on the reciprocally rotating wheel and the pulley. A weight of 3 kg is loaded on the pulley. The yarn is subjected to a fiber-fiber twist-friction test of reciprocal motion of a 79 mm stroke at a rate of 152 strokes/min. The number of strokes until breakage is recorded.

(ii) The above specimen yarn, is subjected to a grindstone abrasion test, while being loaded 1/10 g/d, with a round grindstone having a diameter of 10 cm (rotation: 100 rpm; contact angle 100° ), and the number of rotations at breakage is recorded.

Fatigue resistance

A two-folded cord is prepared from 1500-denier specimen yarn, by twisting 3 plies of the yarn having a primary twist of 280 turns/m to a final twist of 280 turns/m. 20 cords are embedded parallel in rubber to make a belt having a width of 1 inch, and the thus-obtained belt is subjected to a belt flex test at a stroke rate of 160 times/min and a stroke length of 120 mm using an apparatus as shown in FIG. 3. The strength retention after 250,000 strokes is recorded.

Example 1 and Comparative Examples 1 and 2

An aromatic polyester having a composition of 70 mol % of p-oxybenzoyl moiety and 30 mol % of 6-oxy-2naphthoyl moiety was prepared.

The flow temperature, Tm, and the inherent viscosity, $n_{inh}$, of the obtained polymer were 278° C. and 6.32 dl/g, respectively. The $n_{inh}$ was determined as follows: a specimen was dissolved in pentafluorophenol to give a 0.1 wt % solution, and the relative viscosity, $n_{rel}$, the solution was measured in a constant temperature bath at 60° C. with a Uberohde viscometer; then the $n_{inh}$ was calculated from $$\eta_{inh} = \frac{\ln(\eta_{rel})}{C}$$

where C is the concentration of the solution.

The polymer thus obtained was fed to a twin-screw kneading-type extruder, the inside of which was evacuated to 10 Torr from the vent to remove any introduced air and any gas that was generated, sent to the spinning head through a gear pump at a rate of 130 cc/min, filtered with a filter comprising a sand layer and thin metal wire (Finepore NF-06; 10 μ, made by Nippon Seisen Co., Ltd.), and extruded through a spinneret at 320° C. The spinneret had 400 holes each having a diameter of 0.1 mm. The extruded filaments were wound as a yarn onto a perforated bobbin covered with a cushion made of an inorganic fiber having a thickness of 12.5 mm at a rate of 1000 m/min. The shear rate, γ, was 55,200 $sec^{-1}$. The as-spun yarn thus obtained had the following properties:

Yarn denier (DR): 1499 dr
Tensile strength (DT): 12.2 g/d
Tensile elongation (DE): 2.3%

Three packages of the yarn with an apparent density of 0.483 g/cc each weighing about 6 kg were prepared and then subjected to heat treatments under the following conditions A, B and C.

Heat treatment conditions

Common conditions:

The temperature of the gaseous atmosphere and the treating casing was controlled by a computer-program as follows.

(1) The gas and the treatment casing are preheated to 180° C. and the yarn package is placed in the casing (2) Temperature is raised from 180° C. to 240° C. over 1 hour.

(3) Temperature is raised from 240° C. to 260° C. over 1 hour.

(4) Temperature is raised from 260° C. to 280° C. over 2 hour.

(5) Temperature is raised from 280° C. to 285° C. over 6 hour (6) Temperature is lowered from 285° C. to 180° C. over 1 hour During the above procedure the flow rate of the gas is kept constant at 0.3 $Nm^3/m$

Condition A (Comparative Example 1)

99.999% nitrogen was employed as the treating gas.

Condition B (Comparative Example 2)

Dry air (dew point −60° C.) which was dried with molecular sieves was employed.

Condition C (Example 1)

99.999% nitrogen was used from the start of the heat treatment for 4 hours, and thereafter changed to dry air (dew point: −60° C.).

Figure 1:
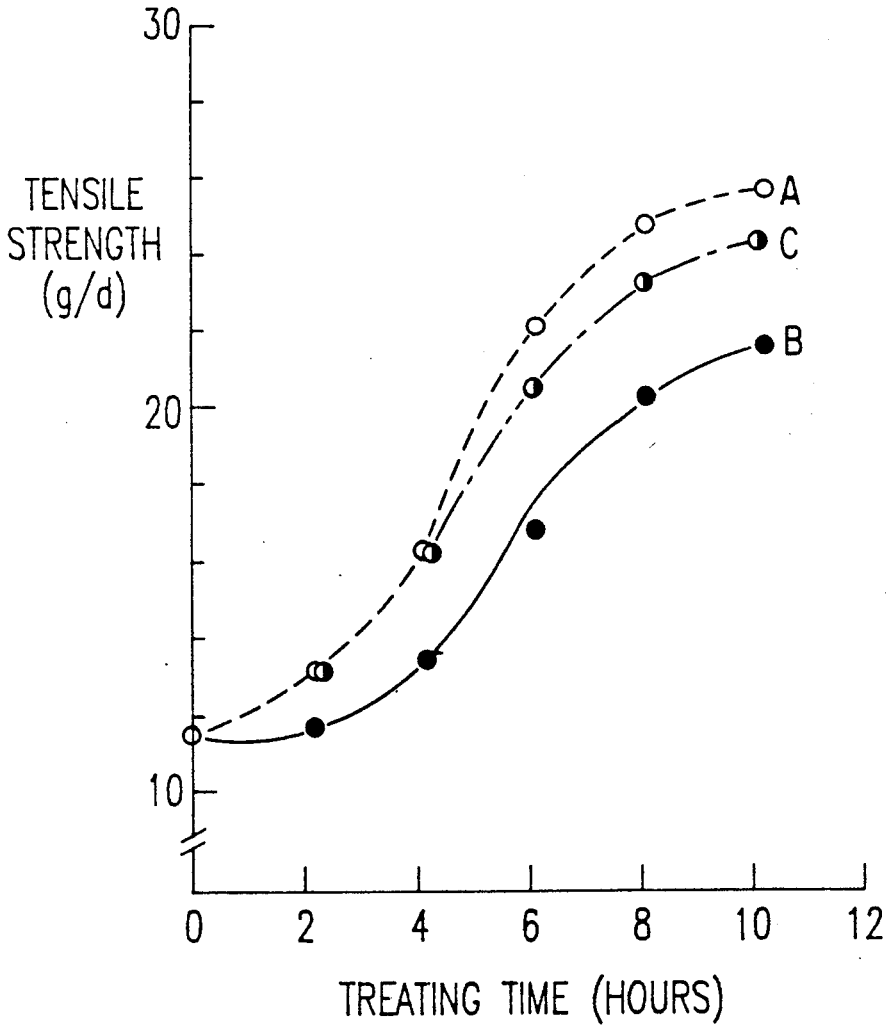
FIG. 1 is a graph showing an example of the relationship between the heat treatment time and the strength increase of the fiber of the present invention when treated in various atmospheres.

After each of the above treatments, the yarn properties were measured FIG. 1 shows the relationships between the treating time and the strength increase obtained in the three tests.

Under Condition C, the strength of the yarn heat treated for 4 hours, i.e. until the change-over from nitrogen to air, was 16.9 g/d, which increased by 38.5% based on the strength of as-spun yarn. The properties of the yarn having undergone the whole treatments are shown in Table 1.

TABLE 1

| Process | Tensile strength (g/d) | Tensile elongation (%) | Young's Modulus (g/d) | Brightness* | Moisture content (%) |
|---|---|---|---|---|---|
| A Comp. Ex. 1 | 26.4 | 3.8 | 602 | 78.2 | 0.04 |
| B Comp. Ex. 2 | 22.2 | 3.3 | 610 | 71.0 | 0.02 |
| C Ex. 1 | 24.0 | 3.5 | 605 | 75.1 | 0.02 |

L* was measured using a Hitachi Color Analyzer System.

The consumption of nitrogen in the heat treatment processes A, B, and C were 33, 0, and 12 $Nm^3$/kg per 1 kg of the yarn treated, respectively.

Process B produced a yarn having a low strength of 22.2 g/d and a remarkable color as seen from L*=71.0. Further, the color of the outermost layer was different from the innermost layer of the 6-kg package, and thus, the commercial value was decreased.

The yarns were evaluated for various characteristics and the results were as shown in Table 2.

TABLE 2

| Process | Fibrillation | Buckling | Resistance to abrasion (strokes) fiber-fiber | Resistance to abrasion (strokes) grindstone | Fatigue resistance (%) |
|---|---|---|---|---|---|
| A Comp. Ex. 1 | X | X | 45,883 | 335 | 72 |
| B. Comp. Ex. 2 | O | Δ | 60,580 | 437 | 85 |
| C Ex. 1 | O | Δ | 58,219 | 413 | 86 |

It is seen from Table 2 that in processes B and C, which comprise treatment in air, fibrillation or buckling, did not occur to a great extent, and the resistance to abrasion or fatigue increased Examples 2 and 3 and Comparative Example 3.

Study was further made to see how the properties of the yarn finally obtained will change as the change-over point of nitrogen to air is changed.

Example 1 was repeated with the change-over times of nitrogen to air of 3 ½ hours (Example 2), ⅓ hours (Example 3) and 5 hours (Comparative Example 3), while other conditions were same.

Table 3 shows the strength increase ratio at the change-over point, which is an index of the change-over time of nitrogen to air and which increases as the treating time increases, and the properties of each of the yarns finally obtained Table 3 also shows the results of Example 1 and Comparative Examples 1 and 2 again for reference.

TABLE 3

| Example | Strength increase ratio (%) | Final Properties: Tensile strength (g/d) | Final Properties: Resistance to abrasion (strokes) fiber-fiber | Final Properties: Resistance to abrasion (strokes) grindstone | Final Properties: Fatigue resistance (%) |
|---|---|---|---|---|---|
| Ex. 1 | 38.5 | 24.0 | 58,219 | 413 | 86 |
| Ex. 2 | 29.5 | 24.2 | 61,005 | 450 | 86 |
| Ex. 3 | 47.5 | 25.3 | 54,573 | 395 | 81 |
| Comp. Ex. 1 | 116.4 | 26.4 | 45,883 | 335 | 72 |
| Comp. Ex. 2 | 0 (untreated) | 22.2 | 60,580 | 437 | 85 |
| Comp. Ex. 3 | 67.2 | 25.6 | 46,212 | 340 | 76 |

FIG. 2 shows the relationship between the strength increase ratio in an inert atmosphere and the tensile strength and the fiber-fiber abrasion resistance of the yarn finally obtained.

It is seen that the yarns obtained in Examples 1 through 3 have high strengths of at least 24 g/d and are at the same time excellent in abrasion resistance and fatigue resistance.

In Comparative Example 3, where the strength increase ratio in an inert gas is 67.2%, which is higher than 50%, there no longer appears the improvement effect of the present invention on the resistance to abrasion and fatigue, and further, nitrogen consumption is large, which is not preferred in terms of production cost.

Examples 4 and 5

Example 1 was repeated except for using, instead of air, a gas comprising nitrogen mixed with 2% oxygen (Example 4) and a gas comprising nitrogen mixed with 10% oxygen (Example 5). The properties of obtained yarns are shown in Table 4.

TABLE 4

| Example | Tensile strength (g/d) | Brightness | Resistance to abrasion (strokes) fiber-fiber | Resistance to abrasion (strokes) grindstone | Fatigue resistance (%) |
|---|---|---|---|---|---|
| Ex. 4 | 26.3 | 76.1 | 55,119 | 399 | 81 |
| Ex. 5 | 25.0 | 75.5 | 58,830 | 402 | 84 |

In both Examples 4 and 5, the desired improvements in resistances to abrasion and fatigue were attained but, since mixed gases of nitrogen and oxygen were used there were little economical advantages.

Example 6 and Comparative Example 4

A polymer chip was obtained from p-acetoxybenzoic acid (40 moles), terephthalic acid (15 moles), (20 moles). The flow temperature of the obtained polymer was 324° C. The polymer was extruded through a spinneret with 100 holes each having a diameter of 0.15 mm at an extrusion rate of 40 cc/min and wound up onto a bobbin at a rate of 600 m/min. The shear rate, $\gamma$, was 20,120 $sec^{-1}$. The yarn, as spun, had a strength of 5.87 g/d.

The yarn was unwound and made into a hank, and the hank was put in an oven and treated for 6 hours while its temperature was raised with heated nitrogen at 300° C.. The yarn, after the treatment, had a tensile 46% The yarn was further treated with dehumidified air of 340° C. for 30 hours (Example 6). The thus-obtained yarn had a strength of 17.6 g/d.

The yarn which was treated with nitrogen only (Comparative Example 4) showed a strength of 22.3 g/d.

Evaluation results obtained on both yarns are shown in Table 5.

TABLE 5

| Example | Tensile strength (g/d) | Tensile elongation (%) | Resistance to abrasion (strokes) fiber-fiber | grindstone |
|---|---|---|---|---|
| Ex. 6 | 17.6 | 2.9 | 23,511 | 158 |
| Comp. Ex. 4 | 22.3 | 3.0 | 16,323 | 105 |

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for producing an armoatic polyester fiber, which comprises:

(i) extruding an aromatic polyester capable of forming an anisotropic melt through a spinneret at a temperature at least 10° C. higher than the flow temperature of said polymer and at a shear rate sufficiently high to obtain an initial spun fiber having sufficient orientation of its molecules to be heat treatable according to the following steps (ii) and (iii) to obtain increased tensile strength and abrasion resistance; (ii) treating said spun fiber at a temperature below the flow temperature of said fiber in an inert atmosphere for a period of time long enough to increase the tensile strength of said initial spun fibers by at least 30% but that does not allow the tensile strength of said fiber to increase by over 50%, to obtain a heat-treated fiber; and (iii) heat treating said heat-treated fiber in an active $O_2$-containing atmosphere having a dew point of −40° C. or below for a period of time to increase its tensile strength by at least 50% based on the strength of said initial spun fiber and to increase its abrasion resistance.

2. The process of claim 1, wherein said aromatic polyester capable of forming an anisotropic melt comprises at least 90% by weight of a portion consisting of the following recurring moieties (I) and (II)

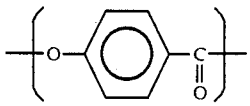

(I)

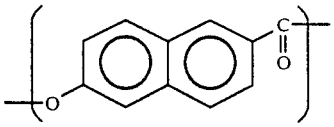

(II)

in which the moiety (II) is contained in an amount of 5 to 50 mol %.

3. The process of claim 1, wherein said inert atmosphere is heated nitrogen gas containing at least 99.9% of nitrogen, and said active atmosphere is a heated gas containing at least 1% of oxygen.

4. The process of claim 2, wherein said inert atmosphere is heated nitrogen gas containing at least 99.9% of nitrogen, and said active atmosphere is a heated gas containing at least 1% of oxygen.

5. The process of claim 1, wherein said active atmosphere is dry air having a dew point of −40° C. or below.

6. The process of claim 2, wherein said active atmosphere is dry air having a dew point of −40° C. or below.

7. The process of claim 3, wherein said active atmosphere is dry air having a dew point of −40° C. or below.

* * * * *